US006814000B2

(12) United States Patent
Friedrichs et al.

(10) Patent No.: US 6,814,000 B2
(45) Date of Patent: Nov. 9, 2004

(54) ADJUSTING DEVICE FOR A SHEET-FED ROTARY PRINTING MACHINE

(75) Inventors: Jens Friedrichs, Neckargemünd (DE); Ralf Wadlinger, Hockenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/054,439

(22) Filed: Jan. 22, 2002

(65) Prior Publication Data

US 2002/0096070 A1 Jul. 25, 2002

(30) Foreign Application Priority Data

Jan. 22, 2001 (DE) ..... 101 02 735

(51) Int. Cl.[7] ..... B41F 13/24

(52) U.S. Cl. ..... 101/217; 101/218; 101/182; 101/184

(58) Field of Search ..... 101/217, 218, 101/182, 143, 144, 145, 184, 185, 139, 140, 137, 247

(56) References Cited

U.S. PATENT DOCUMENTS

| | | | | |
|---|---|---|---|---|
| 3,002,450 A | | 10/1961 | Papa et al. | |
| 5,186,103 A | * | 2/1993 | Gelinas et al. | 101/181 |
| 5,445,076 A | | 8/1995 | Sugiyama et al. | |
| 5,983,795 A | * | 11/1999 | Stein et al. | 101/218 |
| 6,202,555 B1 | * | 3/2001 | Fischer | 101/212 |
| 6,272,986 B1 | * | 8/2001 | Hess | 101/137 |

FOREIGN PATENT DOCUMENTS

| | | |
|---|---|---|
| DE | 465 246 | 8/1928 |
| DE | 1 174 801 | 7/1964 |
| DE | 34 00 652 A1 | 7/1985 |
| DE | 39 02 923 A1 | 10/1989 |
| DE | 40 13 003 A1 | 10/1991 |
| DE | 197 15 242 A1 | 10/1998 |

* cited by examiner

*Primary Examiner*—Andrew H. Hirshfeld
*Assistant Examiner*—Kevin D. Williams
(74) *Attorney, Agent, or Firm*—Laurence A. Greenberg; Werner H. Stemer; Gregory L. Mayback

(57) ABSTRACT

An adjusting device for adjusting a sheet transport cylinder in a sheet-fed rotary printing machine, depending upon various printing-material thicknesses, includes a mounting support for mounting the sheet transport cylinder so that a rotational axis of the sheet transport cylinder is adjustable from a first axial position, which corresponds to a given printing-material thickness, to a second axial position, which corresponds to another printing-material thickness and is axially parallel to the first axial position.

3 Claims, 2 Drawing Sheets

ADJUSTING DEVICE FOR A SHEET-FED ROTARY PRINTING MACHINE

BACKGROUND OF THE INVENTION

Field of the Invention

The invention relates to an adjusting device for adjusting, a sheet transport cylinder in a sheet-fed rotary printing machine, depending upon various thicknesses of printing material.

Such an adjusting device is described in the published German Patent Document DE 39 02 923 A1, wherein an outer cylindrical or jacket surface of the sheet transport cylinder is provided with an outer or jacket film or foil, the outer diameter of which is variable by a variable-height element disposed under the outer film or foil and on a surface of the sheet transport cylinder. The outer film or foil is fixed by an adjusting device to at least one clamping point of the sheet transport cylinder so that a change in the outer diameter of the outer film or foil is effected by the adjusting device. The adjusting device can be operated manually or by a servodrive, for example, a pneumatic servodrive. In the case of a sheet-fed rotary printing machine having many printing units and therefore many sheet transport cylinders, an unacceptably long machine stoppage and refitting time is needed to change the outer diameter of the sheet transport cylinders manually. Although the refitting times can be shortened by using the servodrive, it would have to be integrated into the rotating sheet transport cylinder. This is firstly very complicated to implement in construction terms with regard to the power supply, for example, of a compressed air connection to the servodrive, and secondly is not possible at all in certain cases, for example, because the installation space needed in the sheet transport cylinder for the integration of the servodrive is not available.

Diagonal register adjusting devices described in German Patent DE 465 246 and German Patent Documents DE 34 00 652 C2 and DE 40 13 003 A1 represent only further prior art, and do not correspond to the generic type of adjusting device mentioned in the introduction hereto, and, in these devices, the axis of rotation of the sheet transport cylinder is adjusted to a following position which is skewed with respect to the initial position.

SUMMARY OF THE INVENTION

It is accordingly an object of the invention, therefore, to provide an adjusting device for a sheet-fed rotary printing machine wherein the adjustment is dependent upon various printing-material thicknesses, the adjusting device providing improved construction preconditions for remote operation.

With the foregoing and other objects in view, there is provided, in accordance with one aspect of the invention, an adjusting device for adjusting a sheet transport cylinder in a sheet-fed rotary printing machine, depending upon various printing-material thicknesses, comprising a mounting support for mounting the sheet transport cylinder so that a rotational axis of the sheet transport cylinder is adjustable from a first axial position, which corresponds to a given printing-material thickness, to a second axial position, which corresponds to another printing-material thickness and is axially parallel to the first axial position.

In accordance with another feature of the invention, the mounting support comprises at least one eccentric bearing having an eccentricity.

In accordance with a further feature of the invention, a movement path described by an axis of rotation during an adjustment thereof from the first to the second axial position corresponds to a line which determines a change in cylinder nips, which, in terms of size, is effected at least approximately to the same mutual extent, the nips being formed by the sheet transport cylinder together with adjacent cylinders.

In accordance with an added feature of the invention, the sheet transport cylinder is disposed between another sheet transport cylinder and an impression cylinder.

In accordance with an additional feature of the invention, the rotational axis of the sheet transport cylinder, both in the first and in the second axial position thereof, extends axially parallel to an axis of rotation of an adjacent impression cylinder.

In accordance with yet another feature of the invention, adjusting directions lie at least approximately on a bisector of an angle determined by the axis of rotation of the sheet transport cylinder and axes of rotation of other sheet transport cylinders adjacent to the first-mentioned sheet transport cylinder.

In accordance with a concomitant aspect of the invention, there is provided a sheet-fed rotary printing machine having at least one adjusting device for adjusting a sheet transport cylinder, depending upon various printing-material thicknesses, comprising a mounting support for the sheet transport cylinder so that a rotational axis of the sheet transport cylinder is mounted so that it is adjustable from a first axial position, which corresponds to a given printing-material thickness, into a second axial position, which corresponds to another printing-material thickness and is axially parallel to the first axial position.

The sheet transport cylinder is thus mounted so that the rotational axis thereof can be adjusted from a first axial position (initial position), which corresponds to one printing-material thickness, into a second axial position (following position), which corresponds to another printing-material thickness and is axially parallel to the first axial position.

The adjusting device according to the invention is particularly well suited for remote operation, because if an actuating drive is used to operate the adjusting device, the actuating drive can be arranged in a stationary manner and externally to the sheet transport cylinder. In the case wherein the actuating drive is constructed as a pneumatic operating cylinder, fixing it to a frame of the sheet-fed rotary printing machine arranged beside the sheet transport cylinder is advantageous, because an operating cylinder arranged in this way can be connected to a compressed air source in a straightforward manner via hose lines.

Other features which are considered as characteristic for the invention are set forth in the appended claims.

Although the invention is illustrated and described herein as embodied in an adjusting device for a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
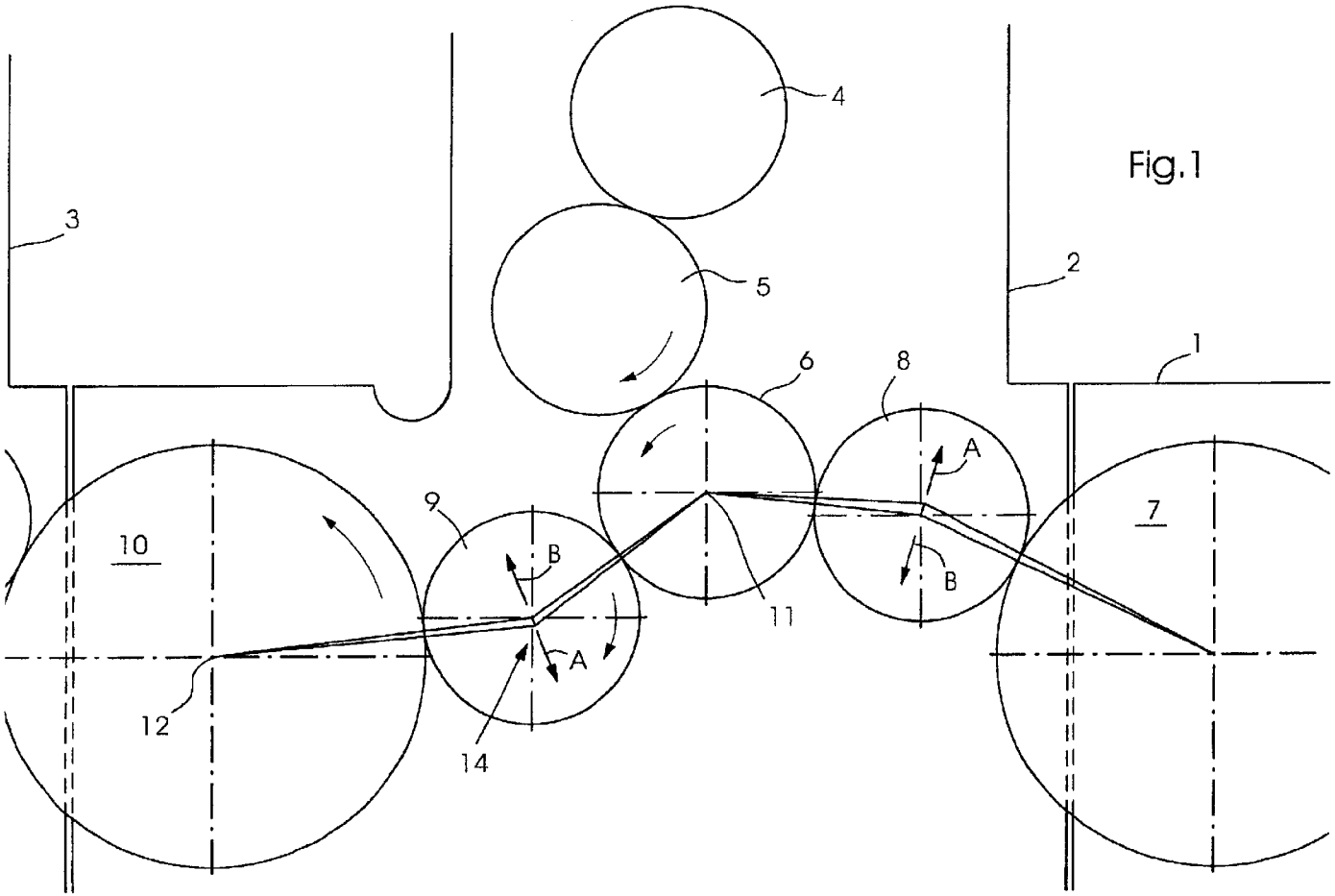
FIG. 1 is a fragmentary diagrammatic side elevational view of a sheet-fed rotary printing machine.

Referring now to the drawings and first, particularly, to FIG. 1 thereof, there is shown therein a sheet-fed rotary printing machine assembled from a plurality of printing units 1 to 3 in in-line construction. The printing unit 2 includes a printing-form cylinder 4, which carries an offset printing form, a rubber blanket cylinder 5 and an impression cylinder 6. As viewed in the transport direction of a sheet of printing material through the sheet-fed rotary printing machine, sheet transport cylinders 7 and 8 are arranged upline of the impression cylinder 6, and sheet transport cylinders 9 and 10 are arranged downline therefrom. The impression cylinder 6 is mounted in a side frame of the sheet-fed rotary printing machine by stationary rotary bearings. The sheet transport cylinder 9 is disposed between the cylinders 6 and 10. A sum formed from the addition of the radii of the cylinders 6 and 10 and the diameter of the sheet transport cylinder 9 is greater than a center spacing between axes of rotation 11 and 12 of the cylinders 6 and 10, respectively.

An axis of rotation 13 (note FIG. 2) of the sheet transport cylinder 9 is mounted so that it can be adjusted by an adjusting device 14 into various axial positions 13*a* and 13*b* and continuously into all the axial positions lying between these axial positions 13*a* and 13*b*. The sheet transport cylinder 9, together with the rotational axis 13 thereof, is mounted so that it can be adjusted in an adjusting direction represented by the arrow A for the purpose of adapting the size of cylinder nips or gaps 15 and 16 to a printing-material thickness of the sheets of printing material to be processed, which is increased when compared with the preceding print job, and so that it can be adjusted in the opposite adjusting direction represented by the arrow B for the purpose of adapting to a reduced printing-material thickness.

Figure 2:
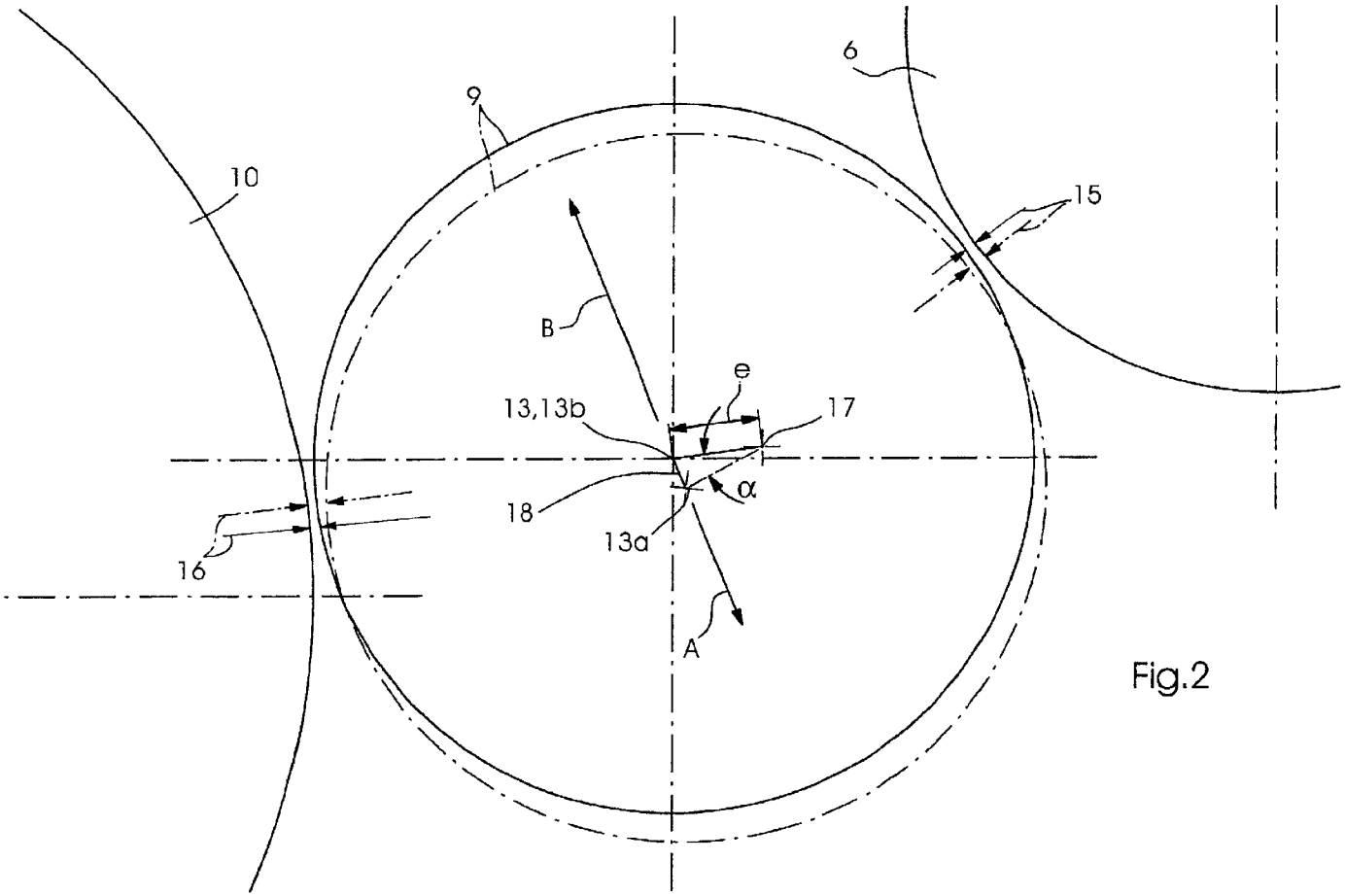
FIG. 2 is an enlarged fragmentary view of FIG. 1 showing a sheet transport cylinder and an adjusting device according to the invention for the sheet-fed rotary printing machine.

In FIG. 2, the sheet transport cylinder 9 is illustrated in phantom in a position thereof resulting from the axial position 13*a*, and with a solid line in the position thereof resulting from the axial position 13*b*. As a result of adjusting the rotational axis 13 in the adjusting direction B from the axial position 13*a* into the axial position 13*b* towards the rotational axes 11 and 12, both the width of the cylinder nip 15 between the cylinders 6 and 9, and the width of the cylinder nip 16 between the sheet transport cylinders 9 and 10 can be reduced in size. By an oppositely directed adjustment of the rotational axis 13 in the adjusting direction A away from the rotational axes 11 and 12, the cylinder nips 15 and 16 can be increased in size. The cylinder nips 15 and 16 can be increased or decreased in size, by the adjustments of the sheet transport cylinder 9 and the rotational axis 13 thereof in the adjusting directions A, B carried out by the adjusting device 14, to an extent which is at least approximately equal with respect to one another and which corresponds to the thickness of the printing material of the sheets of printing material, respectively, to be processed.

The adjusting device 14 includes two eccentric bearings, i.e., one each for each of the two axle journals of the sheet transport cylinder 9. Each of the eccentric bearings is constructed as a pretensioned three-ring bearing, the inner ring of which is formed by a rolling-contact bearing seated on the axle journal of the sheet transport cylinder 9. The rolling-contact bearing is plugged into a central ring, specifically a setting ring that can be rotated about the mid-axis 17 thereof by an actuating drive, for example, a pneumatic operating cylinder. Between the mid-axis 17 and the rolling-contact bearing, and therefore the rotational axis 13, there is an eccentricity e of the eccentric bearing. The central setting ring is plugged into an outer ring of the three-ring bearing so that it can be rotated about the mid-axis 17 thereof. A pivoting angle $\alpha$ of the rotational axis 13 between the axial position 13*a* corresponding to a maximum printing-material thickness and the axial position 13*b* corresponding to a minimum printing material thickness is so small that an arcuate movement path described by the rotational axis 13 as it is adjusted from one of the axial positions 13*a*, 13*b* to the other can be assumed to be a quasi straight line 18. The line 18 guarantees the change in the cylinder nips 15 and 16, which, in terms of size, is carried out at least approximately to the same mutual extent, and which change is effected by the adjustment of the rotational axis 13.

Each of the cylinders 6, 9 and 10 has a gearwheel assigned thereto, which is arranged coaxially with the respective cylinder and firmly connected to the latter so as to rotate therewith. The mutually engaged gearwheels form a gear mechanism via which the cylinders 6, 9 and 10 can be driven in rotation. Tooth play, which changes as a result of the adjustment of the sheet transport cylinder 9 and, therefore, of the gearwheel thereof into one of the setting positions A, B, between teeth on the gearwheel of the sheet transport cylinder 9, and teeth of the adjacent cylinders 6 and 10 can automatically be compensated for by an anti-backlash gear mechanism. For example, an anti-backlash gear or so-called auxiliary gearwheel can be assigned coaxially to the gearwheel of the sheet transport cylinder 9, likewise meshes with the gearwheels of the cylinders 6 and 10 and is biased in the circumferential direction relative to the gearwheel of the sheet transport cylinder 9 by at least one spring. Instead of assigning the auxiliary wheel to the sheet transport cylinder 9, such an auxiliary wheel can also be assigned to the cylinders 6 and 10, respectively, so that each second gearwheel of the gear mechanism connecting the cylinders 6, 9 and 10 is biased.

The cylinders 6, 9 and 10 are equipped with grippers to clamp the printing-material sheet firmly. In order to control the periodic opening and closing of the grippers of the sheet transport cylinder 9, there is assigned to the latter a gripper control cam, which is coupled to the adjusting device 14, so that the gripper control cam can be adjusted synchronously with the sheet transport cylinder 9 in the adjusting direction A or B. As a result of adjusting the gripper control cam by the amount corresponding to the adjustment of the sheet transport cylinder 9, the correctness of the gripper closing times is ensured even after the adjustment of the sheet transport cylinder 9. Furthermore, it is conceivable to take into account an angle which changes as a result of the adjustment between an opening point and a closing point of the grippers of the sheet transport cylinder 9, by subdividing the gripper control cam into a gripper opening cam and a gripper closing cam which, for example, are arranged coaxially with one another. By rotating the gripper opening cam relative to the gripper closing cam, or the latter relative to the former, compensation for the angle which changes as a result of the adjustment of the sheet transport cylinder 9 is possible.

By driving the cylinders 6, 9 and 10 in rotation via the gearwheels of the gear mechanism, the drive being performed with mutually equal circumferential surface speeds of the cylinders 6, 9 and 10, both sides of the printing-material sheet have the same speed while the printing-material sheet is transported through the cylinder nip 15 or 16, so that no displacement is to be feared, relative to the circumferential surface, of the side of the sheet resting on the circumferential or jacket surface of the sheet transport cylinder 9 and provided with a fresh imprint in the printing units 1 and 2, and therefore no smearing of the imprint is to be feared.

Both in the axial positions 13*a* and 13*b* and in every intermediate position lying between these axial positions 13*a* and 13*b*, the rotational axis 13 extends axially parallel to the rotational axes 11 and 12 of the cylinders 6 and 10, respectively. Expressed in other words: when the rotational axis 13 is in the axial position 13*a*, the rotational axis 13 extends parallel to that of the line perpendicular to the plane of FIG. 2, along which the rotational axis 13 extends when the rotational axis 13 is in the axial position 13*b*.

The pneumatic operating cylinder which rotates the central setting ring and functions as an actuating drive in the adjusting device 14 is fitted to the side frame of the sheet-fed rotary printing machine in a stationary manner, for example, by a rotary joint. The supply of power to the actuating drive, i.e., the compressed-air supply to the operating cylinder, is completely uncomplicated. The supply of compressed air is carried out via hoses fixed to the operating cylinder by hose couplings. Advantageously, no rotary valves or rotary lead-throughs are required for the compressed air.

Differing from the illustrated exemplary embodiment, the adjusting device 14 can also include a linear guide, along which the rotational axis 13 can be adjusted into the axial positions 13*a* and 13*b*. The movement path described by the rotational axis 13 during the adjustment thereof along the linear guide into the adjusting position A or B corresponds to an ideal straight line which is the bisector of an angle formed by a first leg, determined by the rotational axis 13 and the rotational axis 11, and by a second leg, determined by the rotational axis 13 and the rotational axis 12. In other words, the rotational axis 13 forms the center of this obtuse angle, and a mid-point center line of the rotational axes 11 and 13 forms the first leg, and a mid-point center line of the rotational axes 12 and 13 forms the second leg.

The bisector would be exactly congruent with the adjusting directions A, B shown in FIG. 2.

The sheet transport cylinder 8 likewise has an adjusting device assigned thereto which, in constructive and functional terms, corresponds to the adjusting device 14.

We claim:

1. A sheet-fed rotary printing machine, comprising:

a first sheet transport cylinder;

a second sheet transport cylinder;

an impression cylinder having a rotational axis;

said first sheet transport cylinder being disposed between said second sheet transport cylinder and said impression cylinder, and said first sheet transport cylinder together with said second sheet transport cylinder and said impression cylinder defining cylinder nips; and an adjusting device for adjusting said first sheet transport cylinder dependent upon various printing sheet thicknesses, said adjusting device including:

a mounting support for mounting said first sheet transport cylinder and for adjusting said rotational axis of said first sheet transport cylinder from a first axial position corresponding to a given printing-sheet thickness to a second axial position corresponding to another printing sheet thickness, said second axial position being parallel to said first axial position; and a movement path described by said rotational axis of said first sheet transport cylinder during an adjustment of said rotational axis of said first sheet transport cylinder from said first to said second axial position corresponding to a line effecting a change in terms of size of said cylinder nips at least approximately to the same mutual extent.

2. The adjusting device according to claim 1, wherein said mounting support comprises at least one eccentric bearing having an eccentricity.

3. The adjusting device according to claim 1, wherein said rotational axis of said first sheet transport cylinder, both in said first and in said second axial position thereof, extends axially parallel to said rotational axis of said impression cylinder.

* * * * *